United States Patent [19]

Takahashi et al.

[11] Patent Number: 4,956,446

[45] Date of Patent: Sep. 11, 1990

[54] POLYESTER FIBER WITH LOW HEAT SHRINKAGE

[75] Inventors: Toshiro Takahashi; Kinsaku Nishikawa; Masami Takahashi, all of Uji, Japan

[73] Assignee: Unitika Limited, Osaka, Japan

[21] Appl. No.: 375,087

[22] Filed: Jul. 3, 1989

[30] Foreign Application Priority Data

Aug. 23, 1988 [JP] Japan ..... 63-208656

[51] Int. Cl.[5] ..... C08G 63/02

[52] U.S. Cl. ..... 528/272; 528/308.1; 528/308.2; 528/485; 528/502; 528/503; 525/437; 264/177.17; 264/210.2; 264/210.7; 264/210.8

[58] Field of Search ..... 528/272, 308.1, 308.2, 528/485, 502, 503; 525/437; 264/177.17, 210.2, 210.7, 210.8

[56] References Cited

U.S. PATENT DOCUMENTS

| | | | |
|---|---|---|---|
| 4,003,974 | 1/1977 | Chantry et al. | 264/210 |
| 4,196,763 | 4/1980 | Imamura | 152/358 |
| 4,209,559 | 6/1980 | Wada et al. | 428/91 |
| 4,246,747 | 1/1981 | Plunkett et al. | 57/245 |
| 4,690,866 | 9/1987 | Kumakawa et al. | 428/364 |

*Primary Examiner*—Morton Foelak
*Assistant Examiner*—Sam A. Acquah

[57] ABSTRACT

Polyester fiber which is characterized as follows:

the fiber is made of polyethylene terephthalate or of polyester in which this is the main component. The fiber has the following combination of property characteristics:

(a) an intrinsic viscosity of 0.70 to 1.05 dl/g
(b) a tenacity of at least 8.0 g/d
(c) an elongation at break of 17% or less,
(d) an amorphous chain size of 60–70 A,
(e) a density at least 1.395 g/cm$^3$,
(f) a dry heat shrinkage of 3.5% or less,
(g) a heat resistance of at least 80%.

2 Claims, No Drawings

POLYESTER FIBER WITH LOW HEAT SHRINKAGE

BACKGROUND OF THE INVENTION

1. Field of the Invention.

This invention is related to polyester fiber which has high strength, low heat shrinkage, excellent heat resistance and is particularly suitable for use in resin-coated cloth or as rubber-reinforcing material.

2. Description of Related Art.

The fiber which is made of polyethylene terephthalate or of polyester in which this is the main component has various excellent properties; consequently, it is used not only for apparel but also widely as reinforcing material such as tire cord, belt, sheet, hose, etc. in industrial applications.

In recent years, for the fibers as industrial materials, high strength, excellent thermal dimensional stability and heat resistance and low elongation characteristics are required. Low elongation characteristics mean not only high modulus but also resistance to deformation when used under high load in commercial products such as resin-coated cloth or rubber structural materials.

In Kokai JP No. 53019-1976, Kokai JP No. 228015-1984 and Kokai JP No. 62910-1987, the methods of obtaining polyester fibers of high strength and low heat shrinkage were proposed. First, the methods described in Kokai JP No. 53019-1976 and Kokai JP NO. 62910-1987 increase the birefringence of undrawn fiber, conduct hot stretching and then conduct relaxation treatment or relaxation heat treatment. However, by these methods, it is difficult to obtain the high strength fiber which has been required in recent years. Particularly by the former method, one can obtain only the fibers which are unsatisfactory not only in strength but also in heat shrinkage characteristics. Next, the method described in Kokai JP No. 228015-1984 improves the uniformity of fiber in the known methods in which undrawn fiber is heat-stretched and then given a relaxation treatment; however, the fiber obtained has the shortcomings of increased heat shrinkage at high temperature (above 180° C.) and inferior heat resistance and so it is not good. Generally, when high strength is desired, the draw ratio naturally needs to be set high but, at this time, it is difficult to maintain the low heat shrinkage; conversely, when low heat shrinkage is desired, strength is inadequate; thus, it is difficult to satisfy the high strength and low heat shrinkage simultaneously.

In other words, this means that, to obtain the polyester fiber having the high performance which is the objective of this invention, considerations of only the fiber properties such as strength, elongation, heat shrinkage, etc. cannot achieve the objective.

This invention intends to provide polyester fiber which has high strength, low heat shrinkage and also excellent heat resistance and low elongation characteristics.

SUMMARY OF THE INVENTION

The essential aspect of this invention is as follows.

(1) Polyester fiber which is characterized as follows: the fiber is made of polyethylene terephthalate or of polyester in which this is the main component. The fiber has the following combination of property characteristics:

(a) an intrinsic viscosity of 0.70 to 1.05 dl/g
(b) a tenacity of at least 8.0 g/d
(c) an elongation at break of 17% or less,
(d) an amorphous chain size of 60–70 Å,
(e) a density at least 1.395 g/cm$^3$,
(f) a dry heat shrinkage of 3.5% or less,
(g) a heat resistance of at least 80%.

Dry heat shrinkage is the shrinkage which occurs when the fiber is heat-treated under no load for 30 minutes in air at 200° C; heat resistance indicates the strength retention, with respect to the untreated fiber, of the fiber which was heat-treated under no tension for 30 minutes in air at 240° C.

DESCRIPTION OF THE PREFERRED EMBODIMENT

In this invention, the above listed properties were measured by the following methods of measurements.

(a) Intrinsic viscosity: Using the equal weight mixture solvent of phenol and tetrachloroethane, measurement was made at a temperature of 20° C.

(b) Tenacity: The value measured by JIS L 1013, i.e. the breaking load in the load-elongation curve divided by the experimentally measured denier of fiber before the measurement of tenacity was taken as the strength.

(c) Breaking elongation: This is the value measured by JIS L 1013, i.e. the elongation at breaking in the load-elongation curve.

(d) Amorphous chain size: The amorphous chain size was calculated by the following equation (1). In equation (1), LP is the long period obtained by applying Bragg's equation from the maximum intensity position (diffraction angle $2\Theta$ of X-ray small angle scatter curve in the meridional direction of fiber; L(105) is the apparent crystal size in the direction of fiber axis in fiber obtained by X-ray wide angle diffraction method.

$$La = LP - [L(105)]r \quad (1)$$

In the measurement of X-ray diffraction, the X-ray generator Model RAD-$\alpha$ B made by Rigaku Denki Co. was used. For both of the wide angle diffraction method and small angle scatter method, the X-ray generator power system involved tube voltage 50 KV, tube current 200 mA, copper anticathode, Ni filter (wave length $\lambda$ k$\alpha$=1.5418A).

On the other hand, as for the optical system, the PMG-RA wide angle goniometer made by Rigaku Denki Co. was used in the case of wide angle diffraction; using symmetric penetration method with the slit system of divergence pinhole diameter 1 mm and light receiving section of 1°–1°, the counter recording was conducted with scintillation counter. In the case of small angle scatter method, a standard slit system was installed on the small angle goniometer of small angle—Model II made by Rigaku Denki Co. to conduct the counter recording.

Apparent crystal size of fiber was calculated by use of Scherrer's equation (2) from the integral width of diffraction peak in the (105) plane $2\Theta = 43°$ expressed by the diffraction intensity in the meridional direction of fiber (p. 140–142, X-ray Crystallography, ed. by I. Jinda).

$$L(105) = K \times \lambda(1)(2)\,(B^2 - b^2)^{\frac{1}{2}} \cos\Theta$$

(k is the constant (1.0) in the integral width method, B is the integral width (rad), b is correction angle ($7 \times 10^{-3}$ rad), $\Theta$ is the diffraction angle (deg).

(e) Density: Following JIS L 1013, the gradient tube made with carbon tetrachloride and ligroin was used and measurement was made at 25° C.

(f) Dry heat shrinkage: Following JIS L 1013, the measurement was made at the heat treatment temperature of 200° C. for a heat treatment time of 30 minutes.

(g) Heat resistance (strength retention): Ring twisting machine was used to apply 20 twists/10 cm to the drawn fiber yarn in S direction or Z direction to make the greige cord. This greige cord was fixed to a metallic frame in a sufficiently slackened state (no load) and heat treatment was conducted at the heat treatment temperature of 240° C. for a heat treatment time of 30 minutes; after this, breaking strength was measured by JIS L 1017. This measured value was divided by the strength value of untreated cord to evaluate the strength retention.

The polyester in this invention is polyethylene terephthalate or the polyester in which this is the main component; various types of dicarboxylic acid component and glycol component can be copolymerized up to about 10 mol %. Also, to improve the heat resistance, it is preferred to reduce the amount of end carboxyl groups by reacting with epoxy compound, carbonate compound, carbodiimide compound or imino ether compound.

First, the polyester fiber of this invention is described.

The polyester fiber of this invention has an intrinsic viscosity in the range of 0.70 to 1.05 dl/g. If the intrinsic viscosity is less than 0.70 dl/g, the high tenacity fiber of at least 8.0 g/d which is required as the reinforcing material cannot be obtained. On the other hand, if it exceeds 1.05 dl/g, heat shrinkage increases greatly and the desired fiber of low heat shrinkage cannot be obtained.

The polyester fiber of this invention has a tenacity of at least 8.0 g/d, preferably at least 8.3 g/d and it can be used suitably as a reinforcing material.

The polyester of this invention has an elongation at break of 17% or less. This low elongation characteristic is normally a property which indicates a high initial modulus; but, in this invention, it is particularly related to the resistance to deformation by external force within breaking stress when it is used as a commercial product such as resin-coated cloth or after being processed into rubber structural material and thus it is more important in practical use than the value of initial modulus.

The polyester fiber of this invention has an amorphous chain size of 60 to 70 Å. Amorphous chain size is a characteristic which is closely related to the strength, dry heat shrinkage and heat resistance of the fiber. If the amorphous chain size exceeds 70 Å, fiber strength drops by the self reduction of crystal size, dry heat shrinkage increases and particularly the high shrinkage at high temperature is severe and, furthermore, strength retention at the time of processing drops. On the other hand, if it is less than 60 Å, strength drops in the same manner as described above. Normally, by stretching the undrawn fiber which is very highly oriented (high birefringence), one can obtain the fiber which has amorphous chain size of less than 60 Å; however, in this case, it is very difficult to achieve high strength by drawing. The undrawn fiber obtained by the common low stress spinning method can be drawn with the addition of sufficient heat treatment in the drawing process to obtain the fiber which has relatively high strength and also an amorphous chain size of less than 70 Å. However, as to the dry heat shrinkage of the fiber obtained, it is relatively low and satisfactory when the treatment temperature is below 180° C.; but, when the treatment temperature is a high temperature above 200° C., the fiber exhibits a shrinkage which is higher than that of the case in which the amorphous chain size exceeded 70 Å as described above and, furthermore, heat resistance drops.

The polyester fiber of this invention has a density which is at least 1.395 g/cm$^3$. If the density is less than 1.395 g/cm$^3$, degree of perfection of crystal is low and one cannot obtain the fiber having high strength and low dry heat shrinkage performance.

The polyester fiber of this invention has a dry heat shrinkage which is 3.5% or less and it has excellent dimensional stability against heat which is applied at the time of resin coating or at the time of vulcanization with rubber. Therefore, this improves not only the cost merit but also the appearance or quality of the processed goods.

The polyester fiber of this invention has a heat resistance (strength retention) of at least 80% when it is heat treated at 240° C. for 30 minutes. It loses little strength by the heat treatment which is conducted in the processing operation and it can maintain the high strength performance adequately.

The polyester fiber of this invention satisfies the above described characteristics simultaneously and, furthermore, it has excellent heat resistance and optimal performance as a reinforcing fiber.

In the following, description is made of the method of making the polyester fiber of this invention.

The polyester fiber of this invention can be made as follows: the molten polyester of high viscosity can be led directly from the polycondensation apparatus to the spinning apparatus or the polyester of high viscosity which was first made into chips can be melted by an extruder, for example, and then led to the above mentioned spinning apparatus; then, spinning is done by the common method and taking up is done at a speed of about 1000–5000 m/min; this can be taken up first or, directly without taking up, this is given drawing and relaxation heat treatment under specific conditions.

In the spinning, in order to enhance the uniformity of yarn which is cooled uniformly, it is necessary to have optimal combinations of the following process variables in connection with the intrinsic viscosity of polyester and spinning speed: Number of filaments in the yarn, filament denier, hole diameter and arrangement of the discharge hole of spinning die, spinning temperature, length of the heated cylinder and the atmosphere temperature in the heated cylinder, length of the cooling zone, temperature and speed of the cooling air, method of blowing the cooling air (blowing from the circumferential direction or blowing from the lateral direction).

To obtain the polyester of this invention, it is necessary to use the high stress spinning method and it is desirable to keep the take up stress of spun fiber (hereinafter, this is called the spinning stress) in the range of 0.05–0.50 g/d. As for the method of increasing the above mentioned stress, there is the method of increasing the cooling speed of spun fiber. So, by the above described high stress spinning, one obtains the undrawn fiber which has a birefringence of at least $20\times10^{-3}$, preferably $25\times10^{-3}$ to $35\times10^{-3}$.

Next, the undrawn fiber obtained is drawn in 1 stage or in multiple stages while heating with heating roller, heating plate, steam jet. After this, heat treatment is applied by heating the yarn uniformly by the heated final drawing roller and the non-contact heater which is attached around it; then the yarn is led to the relaxation roller to impart limited shrinkage; then, after imparting comingling by use of a comingling apparatus, the yarn is taken up by a take up apparatus.

In drawing, one can use either the direct spin drawing method in which is conducted in continuation after spinning or the two process method in which the undrawn fiber is first taken up and then is drawn. Draw ratio is selected suitably depending on the spinning stress at the time of spinning and the drawing temperature and time. Also, the relaxation ratio is determined suitably depending on the draw ratio or heat treatment temperature.

Normally, improvement of strength of the drawn fiber also improves the dry heat shrinkage characteristics. Also, increasing the relaxation ratio for reducing dry heat shrinkage reduces the strength. Therefore, to obtain the fiber with excellent strength and dry heat shrinkage characteristics in this invention, the factors such as polymer viscosity, birefringence of undrawn fiber, draw ratio, drawing temperature and relaxation ratio are particularly important and the process must be conducted under the conditions of optimal combinations.

In the following examples, the invention is described in detail.

EXAMPLES OF APPLICATION

The polyethylene terephthalate chip of various intrinsic vicosity shown in Table 1 was fed to the extruder type melt spinning apparatus and this was spun by use of the spinning die having 250 discharge holes of circular cross section of 0.5mm diameter at various spinning temperatures shown in Table 1. After passing through the heated cylinder of 100 mm length and atmospheric temperature of 300° C. (the atmospheric temperature in the heated cylinder was measured at the position which was 5 cm below the face of spinning die and 2 cm apart in the lateral direction from the filaments which were spun out from the spinning holes of the outermost circumference among the spinning holes arranged concentrically), the cooling air at 20° C. was blown in the circumferential direction at a speed of 50 m/min along a length of 300 mm to cool the spun fibers. Then, spun yarn oil was imparted by the oiling roller and the yarn was taken up at a speed of 2000 m/min by use of the take up roller heated to a temperature of 70° C. Without taking up first, the undrawn fiber was drawn continuously at various draw ratios; after applying the relaxation heat treatment at various relaxation ratios, the yarn was taken up to obtain the drawn fiber of 1000d/250f (Examples of Application 1–8). The change in denier of drawn fiber which occurs with the change in relaxation ratio was adjusted by adjusting the extrusion rate.

Drawing was conducted in 2 stages. Between the take up roller which was heated to the above mentioned temperature and the unheated first drawing roller, the first stage drawing was done to a draw ratio of 1.50. Next, between the first drawing roller and the second drawing roller (Nelson type) which was heated to a surface temperature of 240°–250° C., the second stage drawing was conducted such that the total draw ratio would be about 2.5–2.8, by use of the steam jet apparatus of temperature 470° C. installed at 15 cm downstream position from the first drawing roller. Adjacent to the wrapped yarn of the second drawing roller, a hot plate heated to 300° C. was installed to apply heat treatment to the drawn fiber on the second drawing roller.

The relaxation heat treatment was applied between the second drawing roller heated to the above mentioned temperature and the relaxation roller (Nelson type) heated to 100° C. or 150° C. while relaxing at a relaxation ratio of 7.0–11.5%.

COMPARATIVE EXAMPLE

Polyethylene terephthalate chip of intrinsic viscosity 1.02 dl/g was fed to the extruder type melt spinning apparatus and this was spun at spinning temperature of 305° C. by use of the same spinning die as in Examples of Application. After passing through the same heated cylinder of Examples of Application, the spun fiber was cooled and imparted with the spun yarn oil agent. After this, it was taken up at a speed of 2000 m/min by the take up roller which was heated to the above mentioned temperature. Without taking up the undrawn fiber, it was drawn to a total draw ratio of 2.46 with the temperature of second drawing roller set at 220° C. Without using hot plate for heat treatment, relaxation heat treatment was applied to a relaxation ratio of 1.0% with the relaxation roller temperature set at 100° C., to obtain the drawn fiber of 1000d/250f (Comparative Example 1).

Also, a heated cylinder of 25 mm length with atmospheric temperature of 180° C. was used and the second drawing roller temperature was set at 250° C. and the total draw ratio was 2.28 and relaxation ratio was 4.5%. Other than this, same process as in Comparative Example 1 was used to obtain drawn fiber of 1000d/250f (Comparative Example 2).

Also a heated cylinder of 400 mm length with an atmospheric temperature of 450° C. was used; spinning speed was 450 m/min, first stage draw ratio was 1.002, total draw ratio was 8.00, relaxation ratio was 14.0%. Other than this, the same process as in Comparative Example 2 was conducted to obtain the drawn fiber of 1000d/250f (Comparative Example 3).

Results of Examples of Application and Comparative Examples are shown in Table 1. Also, as a reference example, the example of commercially available low shrinkage type polyester was listed.

The birefringence of undrawn fiber shown in Table 1 was measured with the sample which was obtained by winding the undrawn fiber yarn to the take up roller that was unheated; Nicon polarizing microscope Model POH was used; measurement was done by Berek compensator method with white color light source and using tricresylphosphate as the sealing agent. Also, in the examples of application, the amount of carboxyl group which is related to the heat resistance was in the range of 24.3–25.7 geg/$10^6$g polymer in all cases. Also, in the examples of application, spinning stress was about 0.1 g/d. This spinning stress was determined by dividing with the denier of undrawn fiber yarn the tension of running fiber yarn measured at the position of about 30 cm upstream side from the position where the spun yarn begins to contact the surface of take up roller.

As is clear from Table 1, the polyester fiber of this invention has high strength, low breaking elongation, low dry heat shrinkage and excellent heat resistance.

In contrast to this, the polyester fiber which does not satisfy the above described characteristics of this invention cannot satisfy simultaneously the required performance such as strength, heat shrinkage and heat resistance when used as a reinforcing material in commercial products.

TABLE 1

| | Examples of Application | | | | | | Comparative Examples | | | Reference |
|---|---|---|---|---|---|---|---|---|---|---|
| | 1 | 2 | 3 | 4 | 5 | 6 | 1 | 2 | 3 | Example |
| Polymer Intrinsic Viscosity (dl/g) | 0.85 | 0.85 | 1.02 | 1.02 | 1.13 | 1.13 | 1.02 | 1.02 | 1.02 | — |
| YARN MAKING CONDITIONS | | | | | | | | | | |
| Spinning temperature (°C.) | 285 | 285 | 305 | 305 | 315 | 315 | 305 | 305 | 305 | — |
| Length of heated cylinder (mm) | 100 | 100 | 100 | 100 | 100 | 100 | 100 | 25 | 400 | — |
| Atmosphere temperature in heated cylinder (°C.) | 300 | 300 | 300 | 300 | 300 | 300 | 300 | 180 | 405 | — |
| Cooling air blowing length (mm) | 300 | 300 | 300 | 300 | 300 | 300 | 300 | 300 | 300 | — |
| Cooling air temperature (°C.) | 20 | 20 | 20 | 20 | 20 | 20 | 20 | 20 | 20 | — |
| Cooling air speed (m/min) | 50 | 50 | 50 | 50 | 50 | 50 | 50 | 50 | 50 | — |
| Spinning (m/min) | 2000 | 2000 | 2000 | 2000 | 2000 | 2000 | 2000 | 2000 | 450 | — |
| First stage draw ratio | 1.50 | 1.50 | 1.50 | 1.50 | 1.50 | 1.50 | 1.50 | 1.50 | 1.002 | — |
| Second stage draw ratio | 1.72 | 1.79 | 1.74 | 1.80 | 1.80 | 1.84 | 1.66 | 1.59 | 5.988 | — |
| Total draw ratio | 2.58 | 2.685 | 2.61 | 2.70 | 2.70 | 2.76 | 2.49 | 2.385 | 6.00 | — |
| Relaxation ratio (%) | 7.0 | 11.5 | 8.0 | 9.0 | 10.5 | 9.5 | 1.0 | 4.5 | 14.0 | — |
| Take up speed (m/min) | 4799 | 4752 | 4802 | 4914 | 4833 | 4996 | 4930 | 4555 | 2322 | — |
| Take up roller temperature (°C.) | 70 | 70 | 70 | 70 | 70 | 70 | 70 | 70 | 70 | — |
| First drawing roller temperature (°C.) | Unheated | | | | | | | | | |
| Second drawing roller temperature (°C.) | 240 | 250 | 245 | 255 | 250 | 255 | 220 | 250 | 250 | — |
| Steam jet temperature (°C.) | 470 | 470 | 470 | 470 | 470 | 470 | 470 | 470 | 470 | — |
| Heat treatment heater temperature (°C.) | 300 | 300 | 300 | 300 | 300 | 300 | — | — | — | — |
| Relaxation roller temperature | 150 | 100 | 150 | 100 | 100 | 150 | 150 | 150 | 150 | — |
| Birefringence of undrawn fiber $\times 10^3$ | 22 | 26 | 27 | 26 | 29 | 24 | 28 | 49 | 3 | — |
| Performance of drawn yarn | | | | | | | | | | |
| Intrinsic viscostiy (dl/g) | 0.77 | 0.75 | 0.98 | 0.95 | 1.02 | 1.02 | 0.98 | 0.93 | 0.99 | 0.82 |
| Tenacity (g/d) | 8.6 | 84 | 8.6 | 8.8 | 8.5 | 8.9 | 9.2 | 7.2 | 8.2 | 8.4 |
| Breaking elongation (%) | 14.1 | 16.7 | 14.3 | 15.2 | 16.5 | 15.3 | 11.0 | 12.4 | 23.1 | 19.9 |
| Amorphous chain size (A) | 69 | 65 | 66 | 66 | 63 | 68 | 75 | 55 | 79 | 52 |
| Density (g/cm$^3$) | 1.397 | 1.398 | 1.398 | 1.401 | 1.396 | 1.397 | 1.386 | 1.390 | 1.397 | 1.402 |
| Dry heat shrinkage (%) | 3.0 | 2.3 | 3.1 | 2.8 | 3.3 | 10.2 | 3.8 | 3.4 | 4.7 | |
| Strength retention (%) | 83.9 | 90.1 | 88.8 | 84.5 | 86.7 | 85.3 | 88.3 | 83.2 | 65.4 | 70.7 |

WHAT IS CLAIMED:

1. Polyester yarn which is made from polyethylene terephthalate or from a polyester in which polyethylene terephthalate is the main component, said polyester yarn having the following combination of property characteristics:

(a) an intrinsic viscosity of 0.70 to 1.05 dl/g, (b) a tenacity of at least 8.0 g/d, (c) an elongation at break of 17% or less, (d) an amorphous chain size of 60 to 70 Å, (e) a density of at least 1.395 g/cm$^3$, (f) a dry heat shrinkage of 3.5% or less, (g) a heat resistance of at least 80%.

2. The yarn of claim 1 having a tenacity of at least 8.3 g/d.

* * * * *